US005892326A

United States Patent [19]

Byrum et al.

[11] Patent Number: 5,892,326

[45] Date of Patent: Apr. 6, 1999

[54] LOW PROFILE ELECTRODE ASSEMBLY FOR LUMINOUS GAS DISCHARGE DISPLAY AND METHOD OF MANUFACTURE

[75] Inventors: Bernard W. Byrum, Perrysburg; Robert Carter, Toledo, both of Ohio

[73] Assignee: Electro Plasma, Inc., Perrysburg, Ohio

[21] Appl. No.: 730,094

[22] Filed: Oct. 15, 1996

[51] Int. Cl.[6] ..... H01J 17/49

[52] U.S. Cl. ..... 313/582; 313/584; 313/586; 313/587; 313/635

[58] Field of Search ..... 313/582, 584, 313/586, 587, 635

[56] References Cited

U.S. PATENT DOCUMENTS

| | | | |
|---|---|---|---|
| 1,743,569 | 1/1930 | Purdom | 313/587 |
| 4,198,585 | 4/1980 | Yamashita et al. | 313/587 |
| 4,494,038 | 1/1985 | Wedding et al. | 313/587 |
| 5,634,836 | 6/1997 | Lepselter | 313/587 |
| 5,663,611 | 9/1997 | Seats et al. | 313/584 |

OTHER PUBLICATIONS

Advances in Electronics, vol. I, L. Marton, pp. 106–109.

Theory of Auger Ejection of Electrons from Metals by Ions, Homer D. Hagstrum, Physical Review, Oct. 15, 1954, pp. 336–365.

*Primary Examiner*—Ashok Patel

*Attorney, Agent, or Firm*—MacMillan, Sobanski & Todd, LLC

[57] ABSTRACT

A luminous gas discharge display including two opposing hermetically sealed plates and a pair of low profile electrode assemblies. At least one of the plates is formed of a transparent material and at least one of the plates includes at least one channel terminating in at least one opening through the plate containing an ionizable gas to define a gas discharge path. The electrode assemblies are positioned externally of the glass plates and in communication with channel. Each electrode assembly includes an outer substrate, an intermediate conductive layer deposited on the outer substrate and an inner emissive layer deposited on the intermediate conductive layer opposite the opening. The intermediate conductive layer provides electrical contact between a voltage source and the inner emissive layer to ionize the ionizable gas and produce a gas discharge display.

22 Claims, 2 Drawing Sheets

LOW PROFILE ELECTRODE ASSEMBLY FOR LUMINOUS GAS DISCHARGE DISPLAY AND METHOD OF MANUFACTURE

FIELD OF THE INVENTION

The present invention relates to a low profile electrode assembly for a luminous gas discharge display and a method of manufacture. More particularly, the present invention relates to a low profile electrode assembly for a luminous display such as a sign employing a gas discharge and a method of manufacture.

BACKGROUND OF THE INVENTION

Luminous signs employing a gaseous discharge and the methods for making these signs have been disclosed in several patents. In general, these signs are made by using two or three glass plates where in one or two of the plates is formed a groove or cavity corresponding to the desired display. The cavity is hermetically sealed and attached to a gas entry port incorporating a set of electrodes. In the manufacturing process the cavity is evacuated and a quantity of gas, such as neon, is introduced into the cavity through the gas entry port. The gas is then ionized by applying a voltage across the electrode set. The ionized gas, in turn, causes the display to illuminate.

Heretofore, the electrodes typically consisted of a metal cylinder open on one end and enclosed in a glass tube and having a metal wire which passes through the glass tube to contact the metal cylinder. The electrodes must be prepared prior to use by heating the electrodes to a high temperature under vacuum sufficient to form a metal rich oxide film over the electrodes. The oxide film is of a type commonly associated with thermoionic cathodes, for example, primarily barium oxide. It will be appreciate that heating the electrodes decomposes the metal carbonates to form a metal rich oxide surface which is the electrode surface. The electrodes are typically heated by applying an electric current between the electrodes. It will be appreciated that the metal oxide electrode surface requires formation at temperatures approaching 900 degrees celsius. A gas discharge of a high current sufficient to cause heating of the electrodes to the necessary temperature is ignited typically using air. This approach is described in U.S. patent application Ser. No. 08/658,352, entitled "Luminous Gas Discharge Display", incorporated herein by reference.

Removing the contaminants from the sign improves the life of the sign. The contaminants which are removed during the formation of the electrode are best removed by heating the entire flat sign or tube. However, it will be appreciated that the process of forming the electrodes can also cause strong heating of the channel or tube and also cause breakage in the case of flat panel signs.

Although the many known variations of electrodes for luminous signs have been proven to perform satisfactorily, further improvements of electrodes for luminous signs and methods of manufacture are desired.

Accordingly, it is an object of the present invention to provide a low profile electrode assembly for a luminous gas discharge display and a method of manufacturing the electrode assembly that overcomes problems of the prior art. For example, it is an object of the present invention to provide a method of manufacturing a low profile electrode assembly for a luminous gas discharge display that does not require intense heating of the electrode to form the electrode. Yet another object of the present invention is to provide a low profile electrode assembly which is mounted on the rear of a luminous gas discharge display external of the display. Another object of the present invention is to provide an electrode assembly which produces a spray discharge in a suitable ionizable gas. Still another object of the present invention is to provide a durable electrode assembly which is immune to typical vacuum contaminants and provides a long life performance. Another object of the present invention is to provide a method of manufacturing electrodes of a luminous gas discharge display that is simple and economical.

SUMMARY OF THE INVENTION

Briefly, the present invention relates to a luminous gas discharge display including two opposing hermetically sealed plates and a pair of low profile electrode assemblies. At least one of the plates is formed of a transparent material and at least one of the plates includes at least one channel terminating in at least one opening through the plate containing an ionizable gas to define a gas discharge path. The electrode assemblies are positioned externally of the glass plates and in communication with channel. Each electrode assembly includes an outer substrate, an intermediate conductive layer deposited on the outer substrate and an inner emissive layer deposited on the intermediate conductive layer opposite the opening. The intermediate conductive layer provides electrical contact between a voltage source and the inner emissive layer to ionize the ionizable gas and produce a gas discharge display.

BRIEF DESCRIPTION OF THE DRAWINGS

Further features and other objects and advantages of this invention will become clear from the following detailed description made with reference to the drawings in which.

DETAILED DESCRIPTION OF THE PREFERRED EMBODIMENTS

Figure 1:
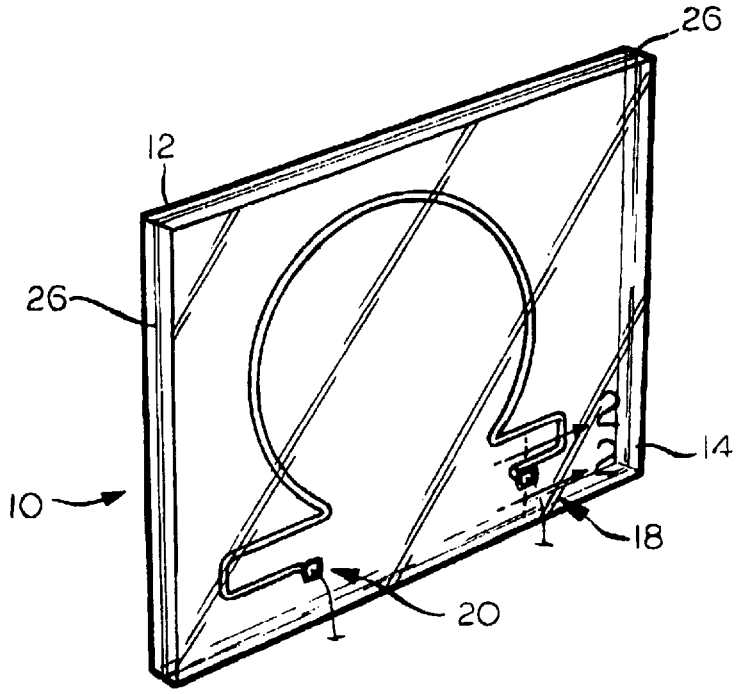
FIG. 1 is an isometric view of a luminous gas discharge display in accordance with the present invention.
Figure 2:
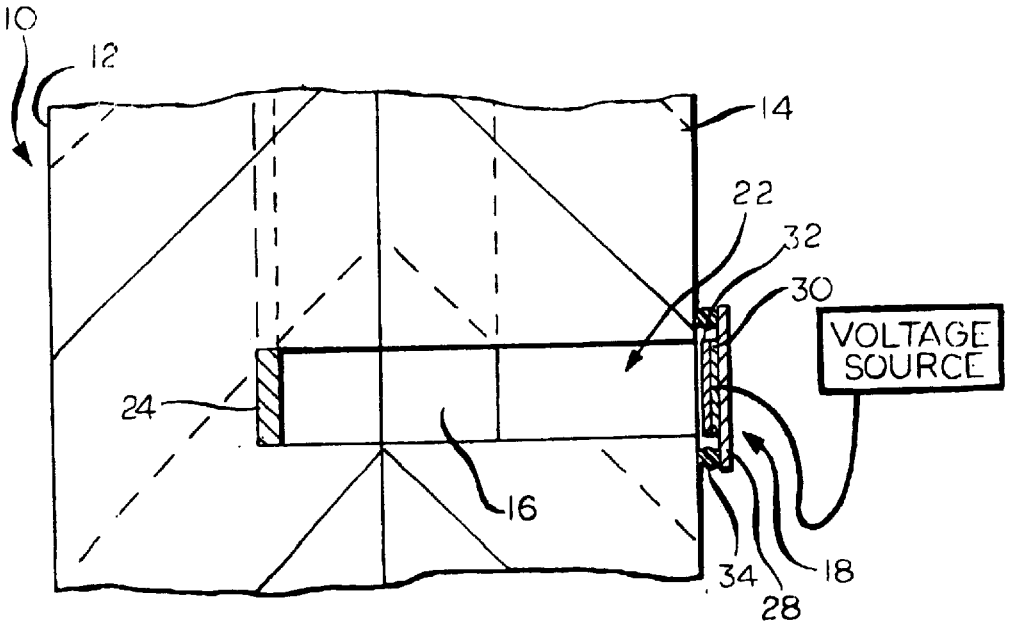
FIG. 2 is a partial cross-sectional view of a low profile electrode in accordance with the present invention taken along line 2—2 of FIG. 1.
Figure 3:
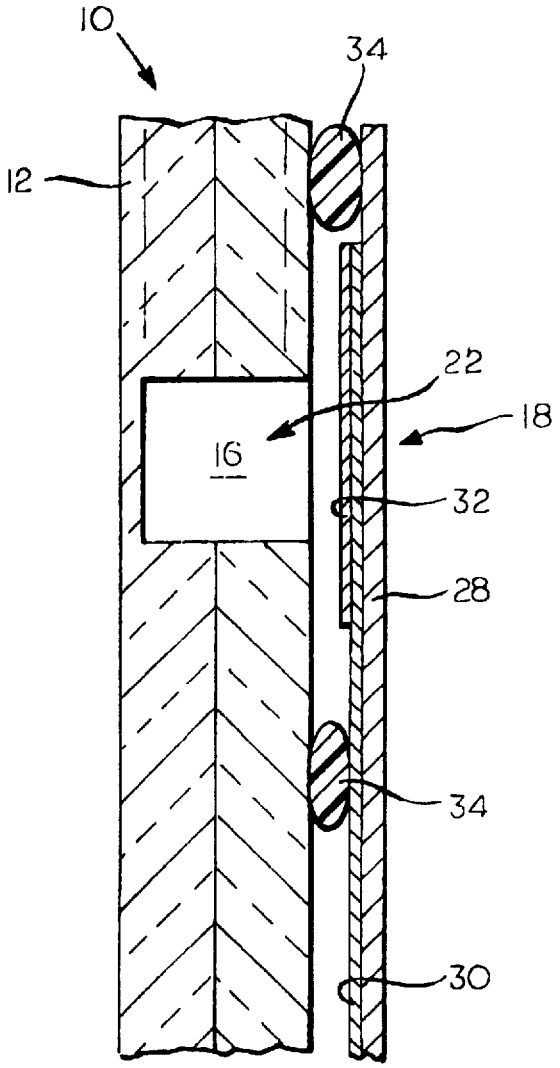
FIG. 3 is a partial cross-sectional view of another embodiment of a low profile electrode assembly in accordance with the present invention.

Referring to the drawings, wherein like reference characters represent like elements, FIGS. 1–3 illustrate a luminated gas discharge display 10. In considering the figures, it will be appreciated that for purposes of clarity certain details of construction are not provided in view of such details being conventional and well within the skill of the art once the invention is disclosed and explained. For example, the various components of the luminated gas discharge display may be assembled using a low temperature frit such as Ferro Corporation glass sealing frit #7075 or Varian Corporation Torr Seal Epoxy and the like.

Referring to the figures, the luminous gas discharge display 10 includes two opposing hermetically sealed plates 12 and 14. At least one of the plates includes at least one channel 16 containing an ionizable gas and defining a gas discharge path. Positioned in communication with the at least one channel 16 are at least two low profile electrode assemblies 18 and 20. It will be appreciated that the low profile electrode assemblies 18 and 20 are located external of the two sealed plates 12 and 14 for ease of manufacture of the plates and the electrode assemblies.

The plates 12 and 14 may be of most any suitable material to withstand temperatures and vacuum levels of gas discharge, which may exceed 100° F., and of most any suitable thickness and size. At least the front plate 12 of the display 10 is formed of a transparent material such as glass or plastic and the like. For example, the glass plate may be formed of soda glass which contains at least 10 percent soda by weight. In a preferred embodiment, both the front plate 12 and the back plate 14 are formed of glass. The plates may be of equal or unequal thickness and may be between about 1.5–12.7 mm thick.

The channel 16 of the display 10 defines the gas discharge path and terminates at each end of the channel in an opening 22 in the back plate 14. It will be appreciated that the channel 16 may be of most any suitable configuration and length as desired. The channel 16 may be in the shape of a continuous tortuous path or in the shape of multiple independent paths configured to appear as letters or numbers. For illustrative purposes, the channel 16 is shown in FIGS. 1–3 in the shape of the greek letter "Ω". It will be appreciated that to facilitate the appearance of separate and distinct figures or characters, the display 10 may include an optional opaque masking layer (not shown) applied to one or more of the plates as well known in the art to mask the sections of the channel 16 interconnecting the figures or characters.

The channel 16 of the display 10 may be formed in the interior surface of one or more of the plate 12 and 14 by most any suitable means well known in the art including sand blasting or other mechanical means. In a preferred embodiment, the channel 16 is formed in one or more of the interior surfaces of the plates 12 and 14 by acid rotting as described In U.S. patent application Ser. No. 08/658,352 entitled "Luminous Gas Discharge Display", incorporated herein by reference.

In one embodiment, after the channel 16 is formed in one or more of the interior surfaces of the plates 12 and 14 a coating of light-emitting phosphor 24 is applied to the display 10 by a means suitable for the depth of the channel. For channels of less than roughly 1.5 mm deep, spray-deposition or silk screening is most appropriate. Spray deposition or screen printing are techniques well known in the industry. For deeper channels, a coating of light-emitting phosphor may be applied manually by brushing the phosphor into the channel, (appropriate for low-volume production) or using a technique known as "settling", accomplished by filling the channel with a suspension of phosphor and a vehicle such as denatured alcohol, and allowing evaporation to occur, during which the phosphor is deposited on the walls of the channel. The light-emitting phosphor 24 may be applied to the interior surface of the front panel 12, to the interior surface of the back panel 14, to the interior surface of the channel 16, or to the flat surface of the front panel or back panel when there is only one plate having a channel formed therein in use. The phosphor 24 changes the light color of the display 10 as required to improve the aesthetics of the display. The light-emitting phosphor 24 may be of most any suitable color and type as well known in the art.

The two plates 12 and 14 are sealed together using a low temperature sealing media 26 of a type well known in the art such as Ferro Corporation Frit #7075 or Varian Corporation Torr Seal epoxy, or other suitable sealing medium. The low temperature sealing media 26 affects a seal about the perimeter of the display 10 without affecting the optical transparency of the plates 12 and 14. The sealing media 26 is placed about the entire outer perimeter of the display 10 to define an inner area circumscribing the channels 16 and an outer border area. In a preferred embodiment, the front plate 12 is hermetically sealed to the back plate 14 and aligned with the back plate so that any mirror image channels 16 formed in the respective plates match.

The electrode assemblies are prepared and hermetically sealed over the openings 22 formed through the back plate 14 of the luminous gas discharge display 10 by appropriate sealing media, such as, but not limited to, a low temperature glass sealing frit or low vacuum epoxy. The vacuum creates a condition of physical and dielectric resistance at all points of contact between the plates 12 and 14 and decreased resistance within the confines of the channel 16 so that the luminous gas discharge follows the contour of the channel as a path of least resistance. In addition, the optical and physical quality of the plates 12 and 14 is preserved because the plates are able to achieve a hermetic seal and never reach the softening temperature of the material forming the plates.

The electrode assemblies 18 are positioned external of the plates 12 and 14 and in communication with the channel 16. As shown in FIGS. 1–3, the electrode assembly is considered "low profile" and is hermetically sealed opposite the channel opening. The electrode assembly may be of most any suitable size to ionize the ionizable gas contained in the channel. It will be appreciated that it is a feature of the present invention that the electrode assembly does not project far from the flat surface of the adjacent glass panel thereby minimizing electrode breakage and providing a low-profile luminous gas discharge display.

Each electrode assembly 18 and 20 includes an outer substrate 28, an intermediate conductive layer 30 and an inner emissive layer 32.

The outer substrate 28 may be formed of most any suitable electrically insulative material to provide a support surface for the intermediate conductive layer 30. Preferably, the outer substrate 28 is a planar sheet material to provide a low profile electrode assembly. The thickness of the outer substrate 28 may be less than 1.0 mm. Most preferably, the outer substrate 28 is of a glass material such as soda glass and the like which may contain at least 10 percent soda by weight.

The intermediate conductive layer 30 is deposited on the outer substrate 28. The intermediate conductive layer 30 is a thin conductive layer that readily adheres to the outer substrate 28 to provide electrical contact between the voltage source (not shown) and the emissive layer 32. In a preferred embodiment, the intermediate conductive layer 30 is a metal layer such as gold, silver, chrome, tin oxide, aluminum ITO (indium-tin-oxide) and the like as well known in the art. The intermediate conductive layer is about 1–10 microns thick. The intermediate conductive layer 30 may be deposited by printing or vacuum thin film deposition techniques as well known in the art.

Deposited on the intermediate conductive layer 30 is an emissive layer 32. It will be appreciated that the intermediate conductive layer 30 and the emissive layer 32 may be required to support up to 10 milliampere of current per square centimeter of surface area. The emissive layer 32 is deposited on a portion of the conductive layer 30 defined within the area of the electrode seal 34. The emissive layer 32 may be an insulative oxide layer such as alkaline-earth metal oxides, e.g., magnesium oxide, or rare-earth metal oxides, e.g., yttrium oxide, and the like. In a preferred embodiment, the emissive layer 32 is about 0.01–0.1 microns thick. The emissive layer 32 may be deposited by printing, sputtering or E-beam physical vapor deposition as well known in the art. In another embodiment of the present invention, the emissive layer may be a diamond-like film material formed from graphite as well known in the art. In a preferred embodiment, the diamond-like film material is about 0.01–1.0 microns thick. The diamond-like film material may be deposited by laser ablation in vacuum, chemical vapor deposition or RF plasma as well known in the art.

As shown in FIGS. 2 and 3, the intermediate conductive layer 30 may be deposited on a portion of the outer substrate 28 circumscribed by the area of the electrode seal 34 or may extend outside of the area of the electrode seal. In either embodiment, the intermediate conductive layer 30 is in communication with the voltage source. Electricity to power the display 10 is supplied to the electrode assemblies 18 and 20 by way of wires 34 from a voltage source such as a transformer or the like of a type well known in the art.

In operation, the starting results from the impressed voltage between the intermediate conductive layers 30 of the electrode assemblies 18 and 20. The impressed voltage is sufficiently high to strike a discharge between the electrode assemblies 18 and 20 causing ionic bombardment of the emissive layers 32 of the electrode assemblies 18 and 20, and the ejection from the emissive layer 32 of sufficient electrons to permit the flow of an operating current. Ions impinge on the emissive layer 32 and positively charge the emissive layer thereby producing a field effect which enhances electron emission and produces a spray discharge for insulative oxide layers such as magnesium oxide and the like. The spray discharge minimizes the field immediately in front of the electrode assemblies 18 and 20 and limits the kinetic energy of the incoming ions. The glow in the electrode assemblies 18 and 20 results from the cloud of electrons and ions which come entirely from the gaseous medium itself, rather than being emitted from the electrode assemblies at high temperature.

Though the invention has been described and illustrated in connection with a luminous display 10, it is recognized that the invention may take other forms. For example, the invention may be back filled with xenon or argon gas and the like and supplied with light-emitting phosphors on the surface of the channel 16 to be used for general and commercial lighting, as a light source for photographic or x-ray viewing, or depending upon the thickness or size of the unit, for any general or specialized lighting requirement for which it may be appropriate.

The patents, patent applications and documents referred to herein are hereby incorporated by reference.

Having described presently preferred embodiments of the present invention it will be appreciated that it may be otherwise embodied within the scope of the appended claims.

What is claimed is:

1. A luminous gas discharge display comprising:

two opposing hermetically sealed plates, at least one of said plates formed of a transparent material and at least one of said plates including at least one channel terminating in at least one opening through said plate, said channel containing an ionizable gas to define a gas discharge path; and a pair of low profile electrode assemblies positioned externally of said glass plates and in communication with said at least one channel, each electrode assembly including an outer substrate of an electrically insulative material, an intermediate conductive layer deposited on said outer substrate and an inner emissive layer deposited on said intermediate conductive layer opposite said opening, said intermediate conductive layer providing electrical contact between a voltage source and said inner emissive layer to ionize said ionizable gas and produce a gas discharge display.

2. The luminous gas discharge display of claim 1 wherein said outer substrate is of a planar sheet material.

3. The luminous gas discharge display of claim 1 wherein said intermediate conductive layer is a metal layer.

4. The luminous gas discharge display of claim 1 wherein said intermediate conductive layer is selected from the group consisting of gold, silver, chrome, aluminum tin oxide, and ITO (indium-tin-oxide).

5. The luminous gas discharge display of claim 1 wherein said emissive layer is an insulative oxide layer.

6. The luminous gas discharge display of claim 1 wherein said emissive layer is an alkaline-earth metal oxide layer.

7. The luminous gas discharge display of claim 1 wherein said emissive layer is a magnesium oxide layer.

8. The luminous gas discharge display of claim 1 wherein said emissive layer is a rare-earth metal oxide layer.

9. The luminous gas discharge display of claim 1 wherein said emissive layer is a diamond-like film material.

10. The luminous gas discharge display of claim 9 wherein said diamond-like film material is about 0.01–1.0 microns thick.

11. The luminous gas discharge display of claim 9 wherein said emissive layer is deposited on a portion of said conductive layer defined within the area of said sealing media.

12. The luminous gas discharge display of claim 9 wherein said intermediate conductive layer is deposited on a portion of the outer substrate circumscribed by the area of the electrode seal.

13. The luminous gas discharge display of claim 1 wherein said electrode assemblies are sealed over said openings by a sealing media.

14. The luminous gas discharge display of claim 13 wherein said intermediate conductive layer extends outside of the area of the electrode seal.

15. The luminous gas discharge display of claim 1 wherein said emissive layer is about 0.01–0.1 microns thick.

16. A luminous gas discharge display comprising:

two opposing hermetically sealed plates, at least one of said plates formed of a transparent material and at least one of said plates including at least one channel terminating in at least one opening through said plate, said channel containing an ionizable gas to define a gas discharge path; and a pair of low profile electrode assemblies positioned externally of said glass plates and in communication with said at least one channel, each electrode assembly including an outer substrate of an electrically insulative material, an intermediate conductive metal layer deposited on said outer substrate and an inner emissive layer of an insulative oxide material deposited on said intermediate conductive layer opposite said opening, said intermediate conductive metal layer providing electrical contact between a voltage source and said inner emissive layer to ionize said ionizable gas and produce a gas discharge display.

17. The luminous gas discharge display of claim 16 wherein said intermediate metal conductive layer is selected from the group consisting of gold, silver, chrome, tin oxide, and ITO (indium-tin-oxide).

18. The luminous gas discharge display of claim 16 wherein said emissive layer is an alkaline-earth metal oxide layer.

19. The luminous gas discharge display of claim 16 wherein said emissive layer is a rare-earth metal oxide layer.

20. The luminous gas discharge display of claim 16 wherein said emissive layer is a diamond-like film material.

21. The luminous gas discharge display of claim 20 wherein said diamond-like film material is about 0.01–1.0 microns thick.

22. The luminous gas discharge display of claim 16 wherein said emissive layer is about 0.01–0.1 microns thick.

* * * * *

UNITED STATES PATENT AND TRADEMARK OFFICE

CERTIFICATE OF CORRECTION

PATENT NO. : 5,892,326

DATED : April 6, 1999

INVENTOR(S) : Bernard W. Byrum, et al.

It is certified that error appears in the above-identified patent and that said Letters Patent is hereby corrected as shown below:

Column 1, third paragraph, line 8, delete "thermoionic" and insert -- thermionic--.

Claim 4, line 3, after "aluminum" insert --,--.

Signed and Sealed this

Twenty-first Day of September, 1999

*Attest:*

Q. TODD DICKINSON

*Attesting Officer*

*Acting Commissioner of Patents and Trademarks*